US005163194A

United States Patent [19]

Dixon

[11] Patent Number: 5,163,194

[45] Date of Patent: Nov. 17, 1992

[54] ADJUSTABLE CERVICAL PILLOW

[75] Inventor: Linda H. Dixon, Honolulu, Hi.

[73] Assignee: Imperial Feather Corporation (Toronto) Ltd., Toronto, Canada

[21] Appl. No.: 829,127

[22] Filed: Jan. 31, 1992

[51] Int. Cl.[5] ..... A47G 9/02

[52] U.S. Cl. ..... 5/636; 5/639; 5/640; 5/643

[58] Field of Search ..... 5/636, 637, 640, 481, 5/901, 639, 643

[56] References Cited

U.S. PATENT DOCUMENTS

| | | | |
|---|---|---|---|
| 3,243,828 | 4/1966 | McCarty | 5/636 |
| 4,259,757 | 4/1981 | Watson | 5/640 X |
| 4,320,543 | 3/1982 | Dixon | 5/636 X |
| 4,777,855 | 10/1988 | Cohen | 5/636 X |
| 4,783,866 | 11/1983 | Simmons et al. | 5/639 |
| 4,853,993 | 8/1989 | Walpin et al. | 5/901 X |
| 4,916,765 | 4/1990 | Castronovo, Jr. | 5/640 |

OTHER PUBLICATIONS

R. Cailliet, Neck and Arm Pain, 2nd Ed., 1981 pp. v, 4-5, 122-123.

*Primary Examiner*—Michael F. Trettel
*Attorney, Agent, or Firm*—Townsend and Townsend

[57] ABSTRACT

A cervical pillow is provided having a multi-component polyurethane foam construction with an upper portion, intermediate portion and foundation portion. The upper portion includes a convoluted support surface preferably having multi-density upwardly extending protrusions and is laminated to the intermediate portion. The intermediate portion is configured having two generally perpendicular channel depressions of equal depth for supporting and stabilizing the head and neck in an anatomically neutral position, the upper portion conforming to the channels and communicating the channel contour to the support surface. Local support adjustment along one channel is facilitated by a cut-out in the intermediate portion which houses a removable insert. The foundation portion includes a removable base to provide adjustable vertical height of the support surface to adapt to a wide range of users. In an alternative embodiment, the foundation portion also includes a removable middle section positionable between an upper section and the base to provide additional vertical support adjustment. The middle portion can be flat or wedge shaped to provide inclination of the support surface when desired. Another alternative embodiment includes a removable cover which encloses the cervical pillow and includes an external pocket positioned over a portion of a channel and removably house a supplemental member such as a thermal pack which can be used for therapeutic purposes.

25 Claims, 4 Drawing Sheets

ADJUSTABLE CERVICAL PILLOW

BACKGROUND OF THE INVENTION

The present invention generally relates to an adjustable pillow used to support a person's head and neck in an optimal posture during sleep or when lying supine. More specifically, the invention is a multi-density multi.layer cervical pillow having adjustable elevation and inclination support to facilitate an anatomically neutral position of the head and neck for a wide range of users.

Research shows that sleep comfort is directly related to sleep posture. Entire industries have developed around the manufacture of alternative bed constructions, each one offering various features directed to achieving a good night's sleep. Posture beds, water beds, spring beds, futons and inclining beds, to name only a few, all offer unique characteristics. The user can select the type of bed construction which best complements their sleep preferences and anatomical build. Most people fail to understand, however, that a pillow can affect sleep comfort as much as, if not more than, the bed.

Unfortunately, most conventional pillows do not offer proper anatomical support and alignment of the head and cervical spine (neck) nor do they offer any adjustability to tailor the support to the particular anatomical characteristics of the user or variations of the sleeping surface. Although one can select a pillow from a wide range of firmnesses and materials, generally pillows are only offered as a one-size-fits-all configuration. The fact is that the build of a specialized athlete, such as a football or rugby player, is quite different than a child or a senior citizen. Shoulder width, head size and neck size can vary enormously between individuals. A pillow which provides proper support and height to a head of a small child sleeping on her side would most certainly not provide proper support or height for a muscular male athlete sleeping on his side, with broad shoulder width elevating the head a greater distance from the sleeping surface. Likewise, some individuals like to sleep on their sides while others enjoy sleeping on their backs or fronts. Each of these positions place the head in a different position and at a different height from the sleeping surface. People accommodate by adopting various sleep habits such as extending an arm under the pillow, doubling up a pillow or using multiple pillows in an effort to achieve comfort, proper pillow support I0 and proper head height. These abnormal sleep postures are the most common cause of neck pain upon awakening and, albeit less frequently, a cause of headache or jaw pain.

The human cervical spine is generally curved, not straight. This curve, called the lordotic curve, is caused by the trapezoid shape structure of the vertebrae in our necks. The cervical spine is composed of seven vertebrae and five moveable joints producing a gentle curve. The seven vertebrae are interconnected to provide protection for the spine while allowing a relatively large range of movement of the head. Nerves extend between vertebrae to connect the spinal cord to sensory and motor nerves throughout our body. As people age, degenerative changes tend to cause the vertebrae to compress together causing arthritis and other ailments. Neck flexion and/or extension injuries, such as "whiplash", cause tissue swelling which can pinch nerves between vertebrae and cause pain. During sleep, abnormal sleep posture resulting in prolonged lack of support or improper support of the neck and head can aggravate these existing conditions or be the primary cause of discomfort.

Improper sleep postures themselves can cause excessive flexion, or rotation or extension of the relatively heavy head and fragile cervical spine during sleep. These sleep postures, including "chin on chest" positions, may lead to damage, twisting or irritation of the cervical spine causing neck pain, neck stiffness or headaches noticeable upon awakening even with people otherwise enjoying excellent health. It has been estimated that up to 70% of headaches originate in the area of the neck and shoulders from a variety of causes, including improper sleep habits.

Frequently, conventional pillows are either too thick and high, thereby over flexing the cervical spine of the user and causing "chin on chest" posture, or too soft and low, thereby bottoming out and leaving the head and neck without either vertical or lateral support. Conventional pillows offer no structural adjustability to compensate for these support deficiencies.

In recognition of these inadequacies, specially shaped pillows have been designed to provide proper head and neck support during specialized medical procedures. One such pillow is described in U.S. Pat. No. 4,320,543, which discloses a medical pillow having a central depression area to provide vertical and lateral support for the head and neck. The purpose of this pillow is to provide proper alignment of the patient,s airway from teeth to lungs to promote circulation and stabilize the head during surgical procedures which require mechanical ventilation of comatose patients. This pillow, however, provides a structure capable of only two different supporting elevations selectable by rotating the pillow at 180° angles. This feature is insufficient to provide meaningful support and comfort options required by a wide range of user anatomies and sleep preferences of the general public during normal sleep.

SUMMARY OF THE INVENTION

In accordance with the invention, an improved cervical pillow is provided having adjustable height, inclination and support features using an improved construction which enhances sleep posture, comfort and durability relative to known pillows. The cervical pillow utilizes removable modular components to achieve adjustable overall vertical height, local support and head inclination.

The cervical pillow of the present invention has a generally rectangular multi.component polyurethane foam structure with an upper portion, a contoured intermediate portion and a foundation portion. The upper portion includes a convoluted support surface having a plurality of multi.density protrusions extending upwardly and is fabricated such that each protrusion has a non-uniform, preferably dual, density from foot to tip. The upper portion is laminated to the top side of the intermediate portion which has a contoured top side with two perpendicular channel depressions of equal depth. The channels can accommodate the neck, and, at their intersection, the head. Due to the bonding between these two layers, the contoured shape of the intermediate portion is acquired by the upper portion and the direction of upward orientation of the protrusions within the channels is thereby altered to provide an enhanced cradling effect on the head for lateral stability.

The intermediate portion includes an elongated cutout disposed below one of the channels and houses a removable and interchangeable insert. The presence or absence of the insert in the cutout will adjust the vertical support height of the user's head by increasing or decreasing the amount of localized support material under the user's head. Thus, removal of the insert will allow the head to displace deeper into the channel relative to leaving the insert intact.

The foundation section lies below the intermediate portion and includes one or more separable layers which lock horizontally by mating topology. In the preferred embodiment, the foundation section incorporates a three.layer structure having an upper layer, middle layer and a base. The upper layer is bonded to the bottom side of the intermediate layer and has a convoluted lower face. The base includes a convoluted upper face which reversely corresponds to the convolute of the lower face to interlock with the same. In the preferred embodiment, a removable middle section is also provided having a convoluted upper side and a convoluted lower side, each mating with the convolute of the lower face of the intermediate layer and the upper face of the base respectively. The vertical height of the pillow can therefor be adjusted by inclusion or omission of the middle section and/or the base. In one embodiment of the invention, the middle section is wedge shaped to provide selective inclination of the support surface to adapt the pillow for use while reading, viewing television or the like or for providing customized support for individuals with medical conditions which benefit from elevation of the head and chest.

The features of adjustability in the present invention provide tailored, comfortable support for the head and neck of a wide range of body physiques to promote an optimal posture such that the cervical spine is in an anatomically neutral position. In an anatomically neutral position, the cervical spine is positioned and supported in proper alignment and curvature thereby avoiding excessive flexion, rotation or extension of the user's head and neck and promoting comfort, safety and better sleep.

These and other features and advantages of the invention are described in more detail below in conjunction with the drawings.

DESCRIPTION OF THE PREFERRED EMBODIMENT

Figure 1:
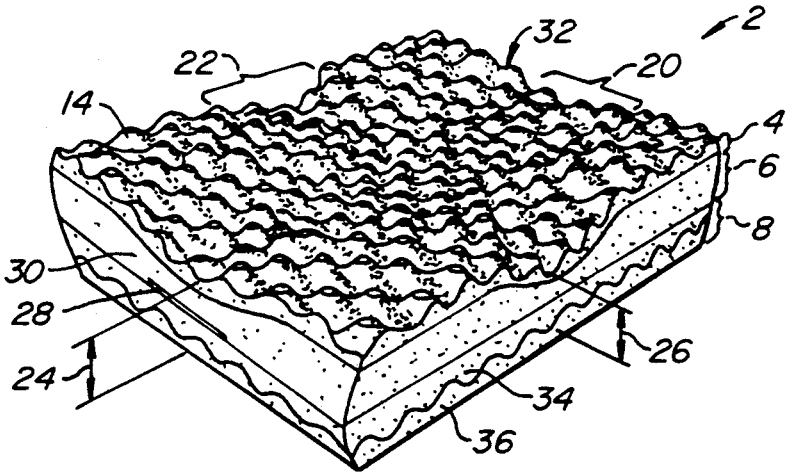
FIG. 1 is a perspective view of the pillow of the present invention shown in an assembled condition.

As shown in FIG. 1, cervical pillow 2 is made generally rectangular in shape preferably sized to fit into a conventional standard size pillow cover. Cervical pillow 2 includes an upper portion 4, an intermediate portion 6 and a foundation portion 8 stacked vertically. Preferably, upper portion, intermediate portion 6 and foundation portion are fabricated from polyurethane open-cell foam sheets cut to the appropriate size and shaped using conventional profiling machines where appropriate. As will be more fully described below, some of the layers are laminated together, some removably interlock.

The particular polyurethane foam or foams used in each layer are selected with a suitable density and Indentation Load Deflection (ILD) value associated with foam compressibility to properly cushion and support a typical human head weighing approximately 10–14 lbs. Although a feature of the invention is a construction which lends itself to customized foam selection to achieve the particular support characteristics desired, it is preferred that upper portion 4 and foundation portion 8 be generally fabricated from a relatively high quality and high density foam(s), while intermediate portion 6 is fabricated from a high quality lower density foam. The generally lower foam density of Intermediate portion 6 relative to upper portion 4 and foundation portion 8 facilitates intermediate portion 6 break-in over time to provide tailored support for the individual's head size and sleeping positions while the generally higher density of upper portion 4 and foundation portion 8 enhances durability for those layers. Generally, upper portion 4 (if made of a single density) and foundation portion 8 has an ILD in the range of 24 to 32 lbs with a density of approximately 1.6–1.8 lbs./ft.$^3$. Intermediate portion 6 has an ILD in the range of 16.20 lbs. with a density of 1.0–1.2 lbs./ft.$^3$. In the preferred embodiment, however, upper portion 4 is itself multidensity as discussed below. These ranges can, of course, be modified to suit the particular application.

Figure 2:
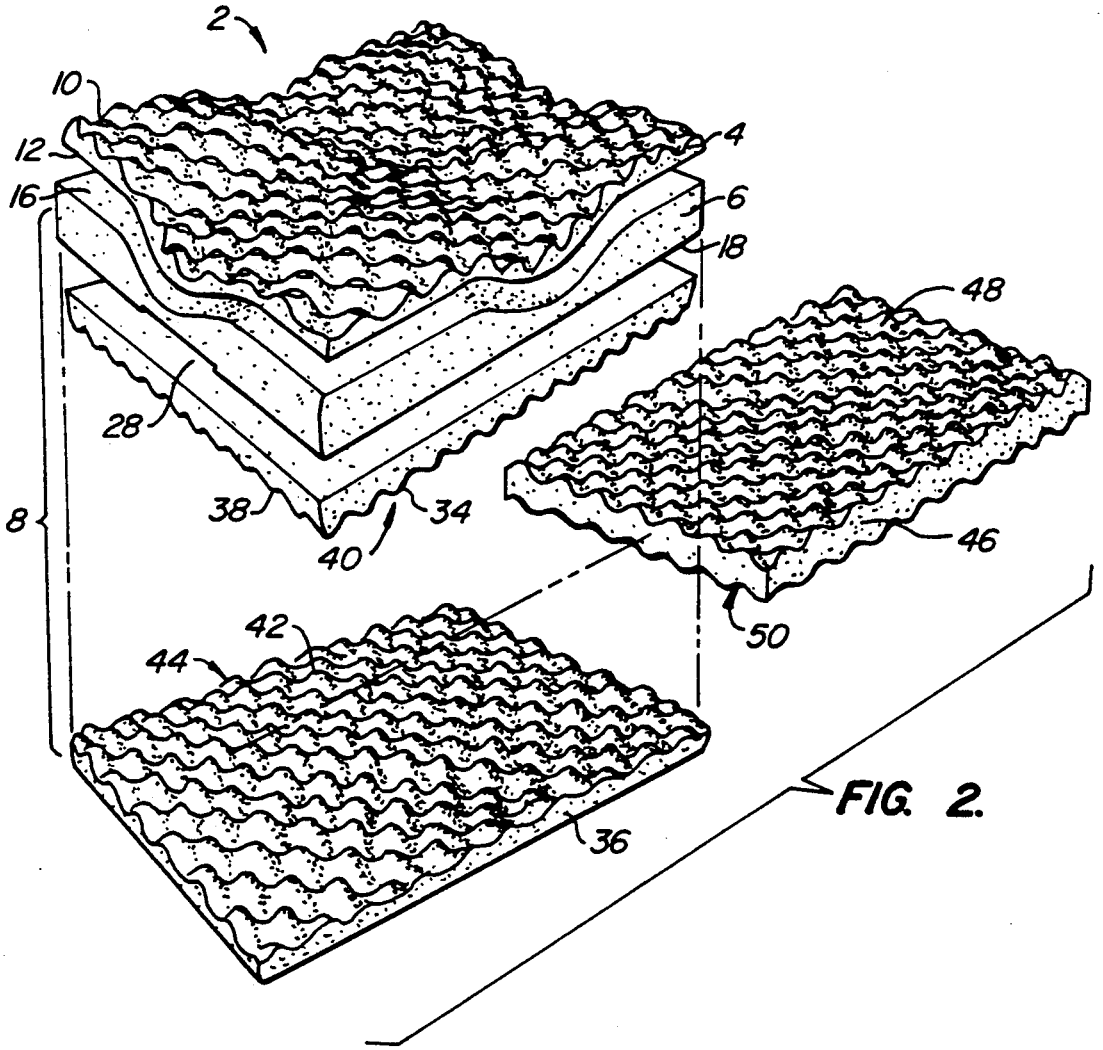
FIG. 2 is an exploded view of the invention shown with the removable middle portion insertable between the upper section and the base of the foundation portion.

To facilitate a better understanding of the structural interconnection of the layers, an exploded view of cervical pillow 2 is provided in FIG. 2. Upper portion 4 has convolute support surface 10 and bonding side 12. Convolute support surface 10 includes a plurality of generally upwardly extending protrusions 14 which are preferably evenly spaced from one another and cover substantially all convolute side 10.

Upper portion 4 is preferably constructed from at least two foam layers stacked vertically and laminated together, each layer of a different foam density. The horizontal junction between layers passes through the topology of the convoluted support surface 10. As a result, the junction divides each foam protrusion 14 into a tip 66 and a foot 68 each having different densities. The thickness and the density of the foam used in each layer forming tips 66 and feet 68 can be selected during fabrication to achieve custom support characteristics desired. For example, the layer of foam comprising the tips 66 of the protrusions is made of a lower density foam than the layer comprising the feet 68 to provide for softer support at the tips 66 relative to the feet 68. In this example, tips 66 can be made having a foam density of 1.0–1.2 lbs./ft.$^3$ with an ILD of 16–20 lbs. and feet 68 having a density of 1.6–1.8 lbs./ft.$^3$ with an ILD of 24–32 lbs. Alternatively, the densities and ILD's can be reversed to provide for a more pronounced convoluted surface sensation as desired. Regardless of the density mix, thickness and orientation, the convoluted support surface 10 enhances weight distribution of the head and neck to reduce pressure, increase ventilation and enhance user comfort.

Intermediate portion 6 includes top side 16 and bottom side 18. Top side 16 is contoured to include two concave channels, first channel 20 and second channel 22 which are generally perpendicular to each other, and generally bisect each other. Top side 16 of intermediate portion 6 is bonded to bonding side 12 of upper portion using suitable techniques. As such, upper portion 4 conforms to the contour of intermediate portion 6 as shown in FIG. 1. First channel 20 and second channel 22 are configured having equal depth, therefore vertical height 24 and vertical height 26 are the same. Although due to the rectangular shape of cervical pillow 2, channel 20 is intended for use as a head channel and channel 22 is intended to cradle the user's neck this structure allows first channel 20 and second channel 22 to be used interchangeably if desired.

Intermediate portion 6 also includes cut-out 28 generally disposed below first channel 20 along its entire length from side wall 30 to side wall 32. Preferably, to simplify fabrication cut-out 28 is made along bottom side 18 of intermediate portion 6. However, cut-out 28 could be made in upper section 34 of foundation portion 8. The vertical depth of cut-out 28 (approximately ¼"1") is selected to facilitate localized adjustment of the vertical support in first channel 20 as will be more fully described below in describing the use of cervical pillow 2.

Foundation portion 8, positioned below intermediate portion 6, includes upper section 34 and base 36. Upper section 34 is laminated or otherwise bonded to bottom side 18 of intermediate portion 6. Base 36 is made removable from upper section 34 to allow for selectable adjustment of effective overall height of convolute support surface 10 when cervical pillow is resting on a plane. Upper section 34 includes a first topography 38 on lower face 40. First topography 38 can be of any desired configuration, but is preferably conventionally shaped convolute formed using conventional profiling machines. Alternatively, interlocking squares, pins and recesses, keys, etc. could be used.

Base 36 includes upper face 42 having a corresponding second topography 44. First topography 38 and second topography 44 are complimentary to allow vertical interconnection, that is, second topography 44 is reverse of first topography 38. First and second topography 38, 44 mate together vertically and horizontally lock base 36 to upper section 34. Base 36 can be removed from upper section 34 simply by vertically separating base 36 and upper section 34 by pulling them apart.

Although not necessary to practice the invention, foundation portion preferably includes an additional module, middle section 46 as shown in FIG. 2. Middle section 46 is configured to mate between upper section 34 and base 36 to provide additional vertical adjustability of cervical pillow 2. Upper side 48 of middle section 46 incorporates a topography preferably identical to the curvature of second topography 44, and lower side 50 incorporates a topography identical to that of first topography 38. This allows middle section 46 to be used with or without base 36 and vice versa.

Figure 6:
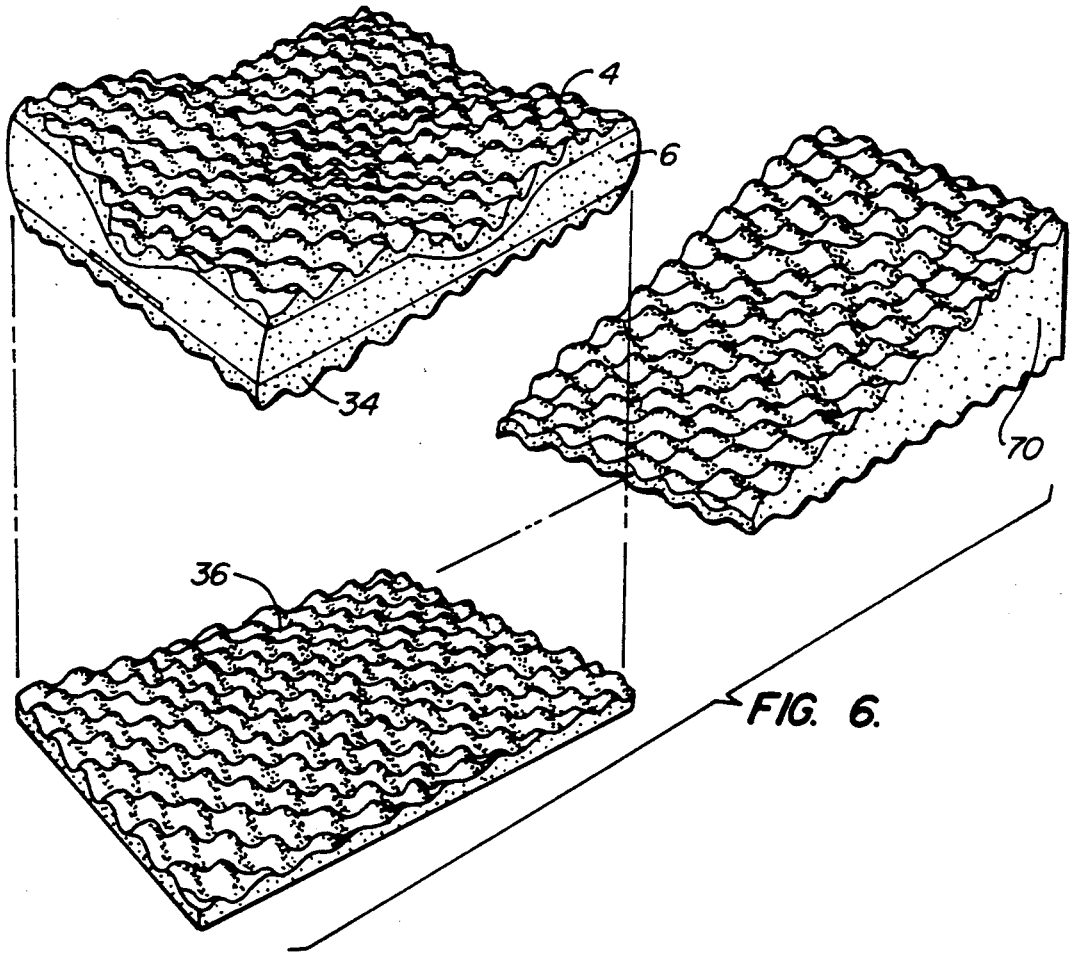
FIG. 6 is an exploded view of the invention shown with the removable middle section configured in a wedge shape.

In an alternative embodiment of the invention, middle section 46 is configured to provide an incline as illustrated in FIG. 6 formed as wedge section 70. Wedge section 70 mates between upper section 34 and base 36 in a manner identical to middle section 46. When incorporated into the assembled stacked construction of cervical pillow 2, wedge section 70 causes upper section 4 to incline, supporting the users head and neck in an inclined position to aid in reading, viewing television, conversing or other activities while laying down. The angle of inclination of wedge section 70 is selected for the appropriate purpose, preferably 5°–30°. Alternatively, several wedge sections 70 having small angles of inclination could be stacked to provide varying degrees of slant or combined with middle section 46 to increase overall height.

Figure 3:
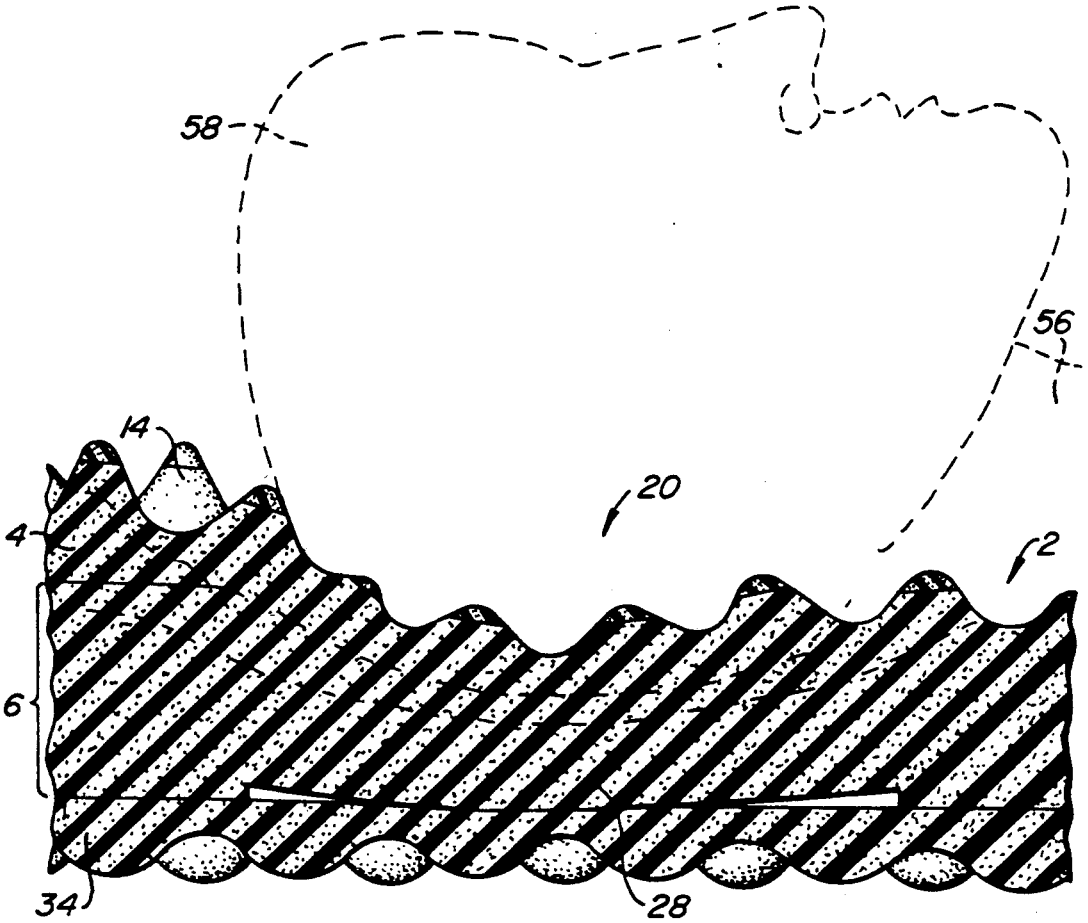
FIG. 3 is a partial cross.sectional view of the invention illustrating the cut-out of the intermediate portion without the insert and a users head shown in phantom with the resulting configuration of the pillow shown with broken lines as the users head is supported in the channel.

Referring now to FIG. 3, cervical pillow 2 is illustrated in cross section with support surface 10 supporting a user's head 58 shown in phantom lines. As can be seen from the drawing, protrusions 14 generally extend upwardly. Upper portion 4 is laminated to intermediate portion 6 as previously discussed. For purposes of discussion, first channel 20 is shown in FIG. 3 but this description applies equally to second channel 22 due to the equal depth of each.

The user's head 58 rests in channel 20 supporting the typical ten to fourteen pounds weight of the head 58. Protrusions 14 support head 58 about the occipital and parietal regions, softly cushioning as they support. The user's neck 56 is cradled in channel 22. When the vertical height of cervical pillow is properly adjusted by use of the removable middle section 46, wedge section 70 and/or base 36, the head 58 and neck 56 is stabilized in an anatomically neutral position.

Also as shown in FIG. 3, protrusions 14 in channel 20 are directed slightly inwardly due to the contour of channel 20. This slight inward orientation helps to stabilize and laterally cushion the users neck 56 and head 58 when positioned in channel 20 as shown in phantom lines. FIG. 3 illustrates cervical pillow 2 with insert 60 removed from cut-out 28. When positioned in channel 20, above cut-out 28, the users head 58 depresses and compresses intermediate portion 6 thereby collapsing cut-out 28. When cut-out 28 is collapsed, the user's head is allowed to locally displace deeper into channel 20 providing an enhance cradling effect. This local support adjustment allows the user to fine tune the support along channel 20 relative to the rest of cervical pillow 2.

Figure 5:
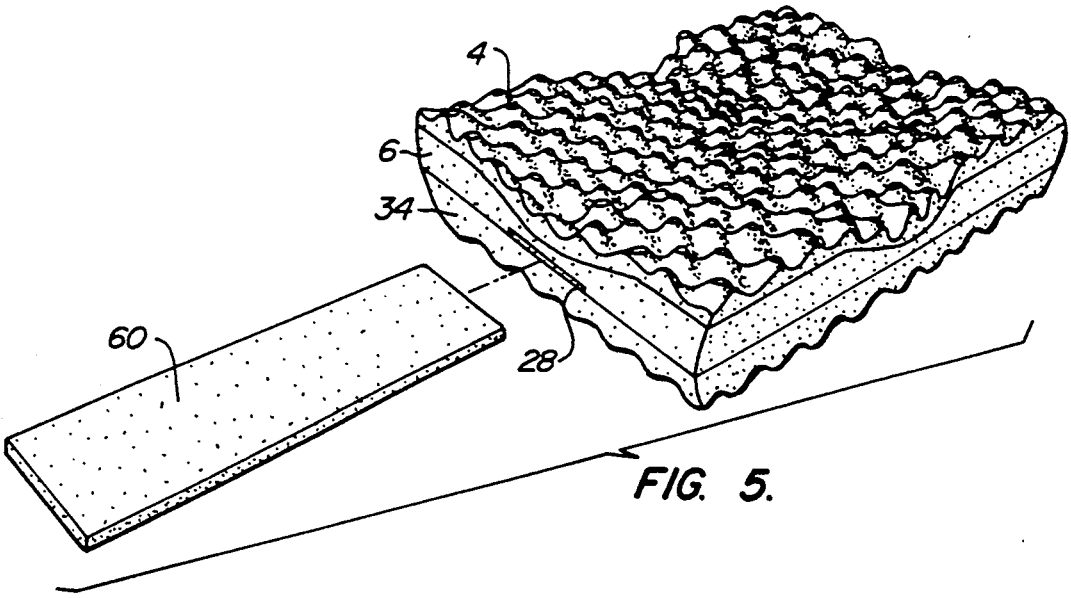
FIG. 5 is a perspective view of the invention adjusted for low vertical height by removing the base and middle section, the pillow shown with the removable insert.

FIG. 5 illustrates insert 60 configured to be removably received in cut-out 28. When insert 60 is positioned in cut-out 28, uniform support is provided across the entire area of intermediate portion 6. Therefore, if the user wishes to have equal support in both channels 20 and 22, insert 60 provides that option. Insert 60 is preferably made of the same material and with the same density as the material used for intermediate portion 6, but can be made of alternative materials and densities as desired. For example, to increase adjustability, cervical pillow 2 can be provided with a wide range of different inserts having differing lengths, thickness and resiliency to allow the user to adjust the support provided along channel 20. Feather packs, ge packs or semi-rigid inserts can also be used to provide specific support and cushioning characteristics.

Figure 4:
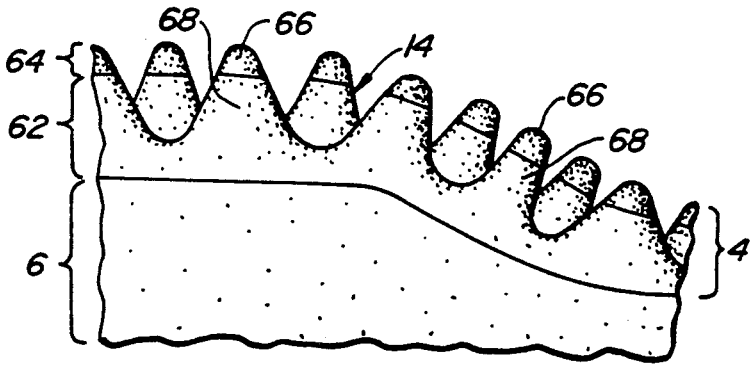
FIG. 4 is a partial side view of the invention illustrating the multi.density upper portion and the generally upwardly extending protrusions formed therein.

Referring now to FIG. 4, a detailed view of upper portion 4 is illustrated with multi-density protrusions 14. Preferably, upper portion is constructed from dual layers of laminated open cell polyurethane foam, a first layer 62 and second layer 64. Upper layer is then convoluted using a conventional profiling machine. The result is multi.layer protrusions 14. The thickness and density of first layer 62 and second layer 64 are selected to the particular application and intended user of cervical pillow 2. This allows "custom" fabrication for the specific user. For example, for users who prefer not to feel the tips 66 of protrusions 14, first layer 62 would be made of a lower foam density relative to layer 64, thereby allowing tips 66 to compress more easily than feet 68 and allowing protrusions 14 to more fully cradle the users head and neck. Likewise, to enhance the rigidity of tips 66 and thereby increase ventilation below the users head and neck, second layer 64 would be constructed from a higher density foam than that of layer 62. Upper portion can be fabricated with first layer 62 and second layer 64 having equal thicknesses or various thickness ratios as desired. Second layer 64 can be made one third the thickness of first layer 62 of visa versa. A nearly infinite combination of thickness and densities can be used to achieve the exact combination of cushioning and support desired.

Therefore, wedge section 70 can be used as an alternative to middle section 46 or in addition to middle section 46 as desired.

Figure 7:
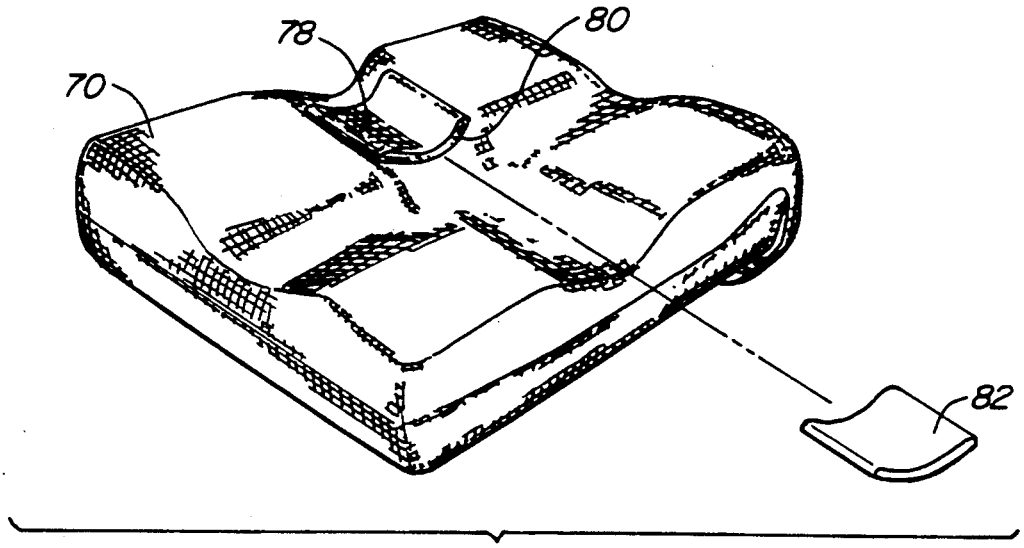
FIG. 7 is a perspective view of the invention disposed in a removable cover, the cover including a pocket for receiving a thermal pack or similarly shaped piece of materials such as foam or fiber.

FIG. 7 illustrates cervical pillow 2 disposed in cover 76. Cover 76 can be made of any conventional material such as cotton, fabric blends, special quilts, etc., or made having elastic portions to provide adaptability and snug fit when cervical pillow 2 is adjusted in height by the addition or removal of base 36, middle section 46 and/or wedge section 70. Because the preferred embodiment of the invention has a rectangular shape similar to conventional stuffed pillows, standard or "king size" conventional pillow cases could be used if desired. However, in an alternative embodiment of the invention, cervical pillow 2 includes a specially designed cover 76 having pocket 78 positioned over channel 22 which, as previously stated, is intended to function as a neck cradle. Pocket 78 includes opening 80 and houses a removable supplemental member 82. Preferably, supplemental member 82 is a thermal pack such as a heat pack or cold pack depending upon the particular application. Alternatively, supplemental member 82 can be a cushion, fiber pack, air chamber, gel chamber or other suitable body to provide therapeutic characteristics.

Neck injuries such as "whiplash" (hyper flexation) respond well to thermal therapy. Cold packs absorb heat, heat packs radiate heat. Placing a cold pack directly or indirectly upon an injured neck will help reduce swelling. Heat packs will help increase circulation and promote healing. Therefore, when used for neck injury therapy, a cold pack would be inserted into pocket 78 to indirectly absorb heat from the damaged or injured tissue of the user and help reduce swelling. After a short period, the cold pack would be replaced with a heat pack to increase blood circulation. Pocket 78 faces into the center of cervical pillow 2 to prevent supplemental member 82 from slipping out of pocket 78. When the user's head is properly positioned on cervical pillow 2, the occipital region of the head helps to retain supplemental member 82 in pocket 78. Although it is preferred that pocket 78 include opening 80 to provide easy removal and replacement of thermal pack 82, opening 80 could include VELCRO® closures or other suitable closures if desired.

The foregoing description of the preferred embodiments of the invention has been presented for purposes of illustration and description. It is not intended to be exhaustive or to limit the invention to the precise form disclosed, and obviously many modifications and variations are possible in light of the above teaching. For example, cervical pillow 2 can be made having other than a rectangular shape. Likewise, protrusions 14 can be made having a wide range of shapes and sizes to create different topologies.

The embodiments chosen and described in this description were selected to best explain the principles of the invention and its practical application to thereby enable others skilled in the art to best utilize the invention in various embodiments and with various modifications as are suited for the particular use contemplated. It is intended that the scope of the invention be defined by the claims appended hereto.

What is claimed is:

1. A cervical pillow for supporting the head and neck of a person, comprising:

a resilient upper portion having a convoluted side and a bonding side, the upper portion including a plurality of generally upwardly extending protrusions substantially covering said convoluted side;

a resilient intermediate portion having a top side and a bottom side, the top side coupled to the bonding side of the upper portion and contoured to include a first recessed channel having a first length and a second recessed channel having a second length, the first and second recessed channels having equal depth, the first recessed channel positioned generally perpendicular to the second recessed channel, the intermediate portion including a cutout having a third length and generally disposed below the first channel; and a multi-layer foundation portion, the foundation portion including an upper section and a base, the upper section being coupled to the bottom side of the intermediate portion and having a contoured lower face of a first topography, the base including a contoured upper face of a second topography, the first topography being generally reverse to the second topography to removably lock the lower face of the intermediate portion in a horizontal orientation to the upper face of the base portion.

2. The cervical pillow of claim 1 further comprising a removable resilient insert positionable in said cutout.

3. The cervical pillow of claim 1 wherein the cutout is disposed in the intermediate portion.

4. The cervical pillow of claim 3 wherein the third length is equal to the first length.

5. The cervical pillow of claim 1 wherein the upper portion is constructed of polyurethane foam.

6. The cervical pillow of claim 5 wherein the density of the foam near the convoluted side of the upper portion is different from the density of the foam near the bonding side of the upper portion.

7. The cervical pillow of claim 6 wherein the density of the foam near the convoluted side is greater than the density of the foam near the bonding side.

8. The cervical pillow of claim 6 wherein the density of the foam near the convoluted side is less than the density of the foam near the bonding side.

9. The cervical pillow of claim 8 wherein the laminate junction passes through a plurality of the protrusions.

10. The cervical pillow of claim 8 wherein each layer of polyurethane foam in the upper portion has a generally equal density.

11. The cervical pillow of claim 6 wherein the upper portion is constructed of at least two layers of polyurethane foam stacked vertically and bonded together at a laminate junction.

12. The cervical pillow of claim 1 wherein the multi.-layer foundation portion further comprises a removable middle section, the middle section having an upper side and a lower side, the upper side constructed having a third topography and the lower side having a fourth topography, the third topography c to removably mate with the first topography and the fourth topography configured to removably mate with the second topography, wherein when said middle portion is disposed between the upper section and the base, the middle portion is restricted from horizontal movement.

13. The cervical pillow of claim 12 wherein the middle section is generally wedge shaped.

14. The cervical pillow of claim 1 further comprising a removable cover configured to encase the upper portion, intermediate portion and foundation portion in an assembled construct, the cover including an external pocket configured to receive a supplemental member.

15. The cervical pillow of claim 14 wherein the supplemental member is selected from the group of a thermal pack, a cushion, a fiber pack, an air chamber or a gel chamber.

16. A cervical pillow for stabilized placement of the head and neck of a person when in a generally horizontal position, comprising:

a multi-density foam portion having a top, a bottom, a first end, a second end and a support surface disposed across the top, the top beingt contoured to include a first recessed channel generally perpendicular to a second recessed channel, the first and second recessed channels formed of equal depth;

a hollow cut-out disposed in the multi-density foam portion communicating from the first end to the second end; and a removable base portion vertically matable with the bottom of the multi-density foam portion to provide selectable adjustment of the overall vertical height of the support surface.

17. The cervical pillow of claim 17 further comprising a removable insert positionable in the hollow cut-out.

18. The cervical pillow of claim 17 wherein the insert is fabricated from foam.

19. The cervical pillow of claim 16 further comprising a removable middle section having a thickness and positionable between the multi-density foam portion and the base, the thickness providign additional adjustment of overall vertical height of the support surface.

20. The cervical pillow of claim 16 wherein the support surface is a convoluted support surface.

21. The cervical pillow of claim 20 wherein the convoluted support surface includes a plurality of generally upwardly extending protrusions, the protrusions each having a foot and a tip, the foot having a different foam density than the foam density of the tip.

22. The cervical pillow of claim 16 further comprising a cover configured to generally encase the pillow, a pocket secured to the cover and a removable supplemental member positionable in said pocket.

23. The cervical pillow of claim 22 wherein the pocket is external to the cover.

24. The cervical pillow of claim 22 wherein the supplemental member is selected from the group of a thermal pack, a cushion, a fiber pack, an air chamber or a gel chamber.

25. The cervical pillow of claim 16 wherein the hollow cut-out is aligned with and located beneath the first channel.

* * * * *